United States Patent [19]

Kurita

[11] 4,198,049

[45] Apr. 15, 1980

[54] GAME WITH REVERSIBLE, SELF-PROPELLED TARGET OBJECT

[75] Inventor: Toshiaki Kurita, Tokyo, Japan

[73] Assignee: Tomy Kogyo Co., Inc., Tokyo, Japan

[21] Appl. No.: 971,939

[22] Filed: Dec. 21, 1978

[30] Foreign Application Priority Data

Jun. 13, 1978 [JP] Japan ..... 53-71636

[51] Int. Cl.[2] ..... A63B 63/00; A63H 29/08

[52] U.S. Cl. ..... 273/119 A; 273/127 R; 273/359; 273/387; 46/212; 273/DIG. 26

[58] Field of Search ..... 273/105.2, 127 R, 119 R, 273/119 A; 46/212

[56] References Cited

U.S. PATENT DOCUMENTS

| | | | |
|---|---|---|---|
| 1,817,491 | 8/1931 | Littlefield | 273/105.2 |
| 2,188,292 | 1/1940 | Hull et al. | 273/105.2 |
| 2,481,686 | 9/1949 | Roggenstein | 46/212 |
| 2,625,831 | 1/1953 | Saunders | 46/212 |
| 2,678,215 | 5/1954 | Peterson et al. | 273/127 R |
| 3,132,864 | 5/1964 | Glass et al. | 273/127 R |
| 3,151,866 | 10/1964 | Glass et al. | 273/105.2 |
| 3,324,832 | 6/1967 | McCain | 119/29 |
| 3,865,373 | 2/1975 | Knight | 273/105.2 |
| 3,891,216 | 6/1975 | Ehsmann et al. | 273/119 R |
| 4,042,243 | 8/1977 | Hoel et al. | 273/119 B |

FOREIGN PATENT DOCUMENTS

| | | | |
|---|---|---|---|
| 337714 | 6/1921 | Fed. Rep. of Germany | 273/108 |
| 14310 | 6/1926 | Netherlands | 273/119 R |

OTHER PUBLICATIONS

Games Magazine, Rec.'d 10/18/78, "Cross Fire Game" advertisement.

*Primary Examiner*—Richard C. Pinkham
*Assistant Examiner*—Lawrence E. Anderson
*Attorney, Agent, or Firm*—Kay H. Boswell; Edward D. O'Brian

[57] ABSTRACT

A toy game of skill between two players is described wherein a track having a first end and a second end includes at least one surface extending between the first and the second end. Located at each end of the track and integrally mated with the track is a projectile launcher. At least one projectile, a small heavy spherical object, is ejected forcibly by the projectile launcher along the surface of the track. Resting on the track is an object member. The object member includes a self-propelling internal locomotion device which moves the object member back and forth reversibly between the projectile launchers located on the ends of the track. The object member also includes a reversing mechanism which reverses the direction of movement of the object member on the track and part of the reversing mechanism is an external trip member which projects out of the object member and if struck by the projectile, emitted from one of the projectile launchers when the object member is traveling toward that projectile launcher, the trip member is tripped causing the object member to reverse its direction toward the other projectile launcher. If the object member is allowed to approach within a certain distance from either one of the projectile launchers a signal is activated indicating that the player who was using that particular projectile launcher has been defeated.

13 Claims, 8 Drawing Figures

10
12
14
16
18
20
22
24
26
90
118
154
226
232
234
224
2
6

10
12
14
16
72
75
118
208
210
212
214
216
218
222
224
226
232
234
254
260
262
264
268
274

GAME WITH REVERSIBLE, SELF-PROPELLED TARGET OBJECT

CROSS REFERENCE TO RELATED APPLICATIONS

This application is related to my application concurrently filed with this application and entitled TOY VEHICLE HAVING REVERSING MECHANISM, Ser. No. 972,018, the disclosure of which is herein incorporated by reference.

BACKGROUND OF THE INVENTION

This invention is directed to a game played by two people having a track interspaced between two projectile launchers. Situated on the track is an object which is capable of reversing direction in response to being struck by a projectile launched from either of the projectile launchers.

There are many games such as a penny arcade shooting gallery wherein an individual tests his skill and accuracy in shooting by attempting to hit movable objects. In this same vein there are games such as that described in German Pat. No. 337,714 which issued June 17, 1921 where an individual pits his skill against a mechanical device. This game is constructed to include a track having a series of bumps or waves therein and a gun attached to one end of the track which is capable of firing missiles toward the other end of the track. On the other end of the track is placed a wind-up tank-like device having a target positioned on the tank which is coupled to the drive mechanism of the tank such that if the target is hit by one of the missiles further progress of the tank toward the gun is halted. The players skill is measured by how close the tank approaches the gun before the player can sucessfully stop the tank.

This type of game can be improved by utilizing two projectile launchers each under the control of a separate player such as that described in U.S. Pat. No. 3,891,216 to Ensmann et al. In this type of game each player has under his control a pistol styled gun and attached to the gun is a cowboy shaped target. The guns, in turn, are each independently attached to a long member which is pivoted about the center of the game. This allows each player's gun and target to be moved in an arc along the respective ends of the gameboard. The target in this game because it is fixed ultimately to the long member has one degree of freedom, i.e., it is movable in respect to the arc which is prescribed to it by its attachment to the gun and the long member.

While the above noted games are considered to be interesting to play and entertaining, it is felt that there is a need for additional games of skill between two players. Further, in any game in which missiles or projectiles are fired and which might be played by small children, included in the game should be features wherein use of missiles or projectiles is done in a safe manner. Because as times change children's interests are directed to new folk heros and fantasies, a game which may be interesting to one generation of children because of their social backgrounds may not be interesting to a subsequent generation of children. This, in effect, limits the social acceptance of a game by one generation of children from that of a preceding generation.

Thus, while cowboy and indian games may have been in vogue at one time, current exposure to television and movies at the present time have generally created a different consciousness in today's children and their games are presently most interesting when they utilize the current themes.

BRIEF SUMMARY OF THE INVENTION

In view of the above it is an object of this invention to provide a contest of skill between two players wherein each player is in the control of a missile launcher and launches missiles toward a target. It is a further object that the use of these missiles is done in a safe and sane manner so that small children cannot accidentally or on-purpose injure each other while using the game. It is an additional object to provide a game that is stimulating and thus capable of maintaining a child's interest for an extendable period of time and yet is still economically and conveniently manufactured rendering the game accessible to a large segment of the population.

In view of the above objects and other objects which will become evident from the remainder of this specification there is provided a game to be played by two players which has a track having a projectile launcher attached to both ends of the track, and a movable object located on the track which traverses back and forth between the projectile launchers; the object including an internal locomotion means and a trip member which if struck by a projectile and appropriately tripped will cause the object member to reverse in direction and move toward the other player's projectile launcher. The track can include a recessed channel which extends along the length of the track and communicates with the projectile launchers such that a projectile ejected from the projectile launcher is ejected into the recessed channel. The trip member can fit into the recessed channel and thus is exposed and can be struck by the projectile as the projectile travels through the recessed channel. In order to add an additional challenge to the game the trip member can be caused to move up and down retracting into and extending from the object member such that it is alternately exposed to being struck by a projectile and then retracted out of the path of the projectile.

BRIEF DESCRIPTION OF THE DRAWINGS

The invention will be better understood when taken in conjunction with the drawings wherein.

The invention shown in this specification and drawings utilizes certain operative principles and concepts as are set forth and defined in the appended claims. Those skilled in the art to which this invention pertains will realize that these principles and concepts could be applied to a number of differently appearing embodiments. For this reason the invention is not to be construed as being limited to the exact embodiment but is to be construed in light of the appended claims.

DETAILED DESCRIPTION

Figure 1:
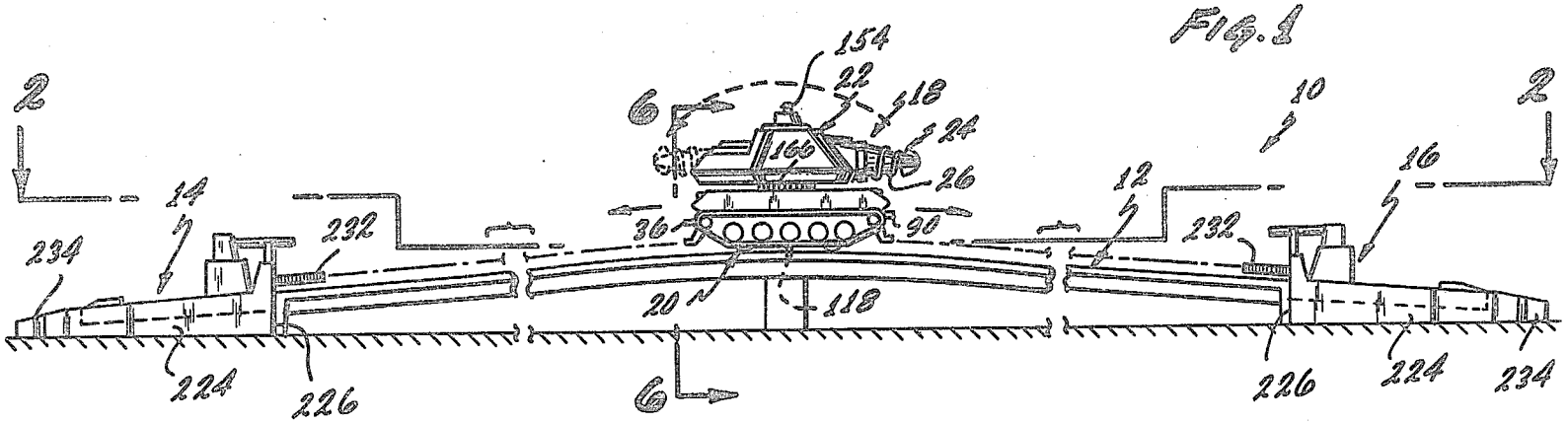
FIG. 1 is a side elevational view of the toy showing all of the different components as they would be during operation of the toy.
Figure 2:
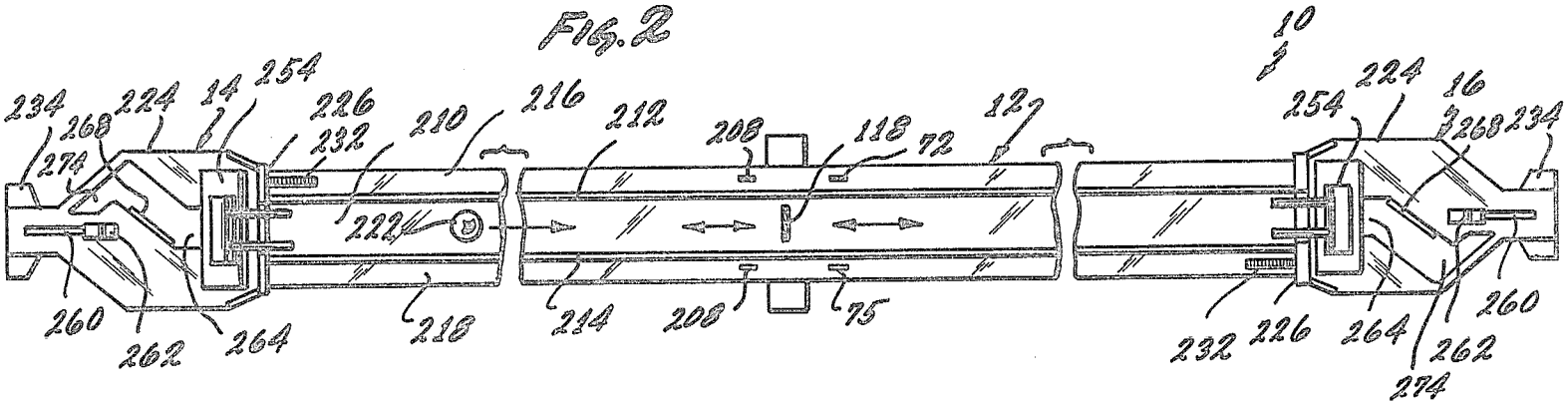
FIG. 2 is a top plan view about the line 2—2 of FIG. 1.

Referring now to FIGS. 1 and 2 the toy 10 consists of four main components: a track 12 extending between a left projectile launcher 14 and a right projectile launcher 16. Riding on top of the track 12 is a vehicle 18 which is generally in the shape of a futuristic styled tank.

The vehicle 18 has two main sections. A base section 20 and a turret section 22 which is rotatably mounted as hereinafter described on top of the base section 20. Projecting out of the front of the turret 22 is a conical member 24 having a helical screw 26 on the surface thereof which turns when the vehicle is moving as hereinafter described.

The base 20 is composed of a top section 28 and a bottom section 30 and together they form a housing for numerous gears and other parts. For the sake of simplicity in this specification generally most of the gears and axles found in the interior of the base 20 will only be described as to their operation. The top and bottom sections 28 and 30 of base 20 contain numerous drillings and cutouts which serve as mountings or bearing surfaces for these components. It will be understood that all of the gears, axles, etc. are appropriately conventionally mounted within the base 20.

A motor 32 is connected by suitable wiring 34 to an off/on switch 36 and a battery pack 38. When in the on position the motor 32 drives pinion 40 which is engaged with a spur gear 42. Integrally formed with spur gear 42 is pinion 44. Pinion 44 mates with and drives spur gear 46. Spur gear 46 is fixedly attached to axle 48 and also mounted to axle 48 and integrally formed with spur gear 46 is pinion 50. A drum 52 is mounted adjacent to pinion 50 on axle 48; however, drum 52 is freewheeling about axle 48 and its rotation on the axle 48 is theoretically independent of both pinion 50 and spur gear 46. A small axle 54 projects from one side of drum 52 toward pinion 50. A pinion 56 is mounted on axle 54 and engages with pinion 50. Thus, as pinion 50 spins about axle 48 pinion 56 is caused to rotate about axle 54.

A spur gear 58 is mounted to an axle 60. A large pinion 62 is also attached to the axle 60 and is rotated by axle 60 in response to rotation of spur gear 58. A spur gear 64 identical in size and teeth number with spur gear 58 is mounted below spur gear 58 about an axle 66 and axle 66 is so placed within bottom section 20 that the teeth of spur gear 64 mesh with the teeth of spur gear 58. Integrally formed with and coaxial with spur gear 64 on axle 66 is a pinion 68. Pinion 68 engages with a spur gear 70 which is integrally formed with a driving wheel 72 mounted on an axle 74. On the opposite side of axle 74 is a second driving wheel 75.

Figure 3:
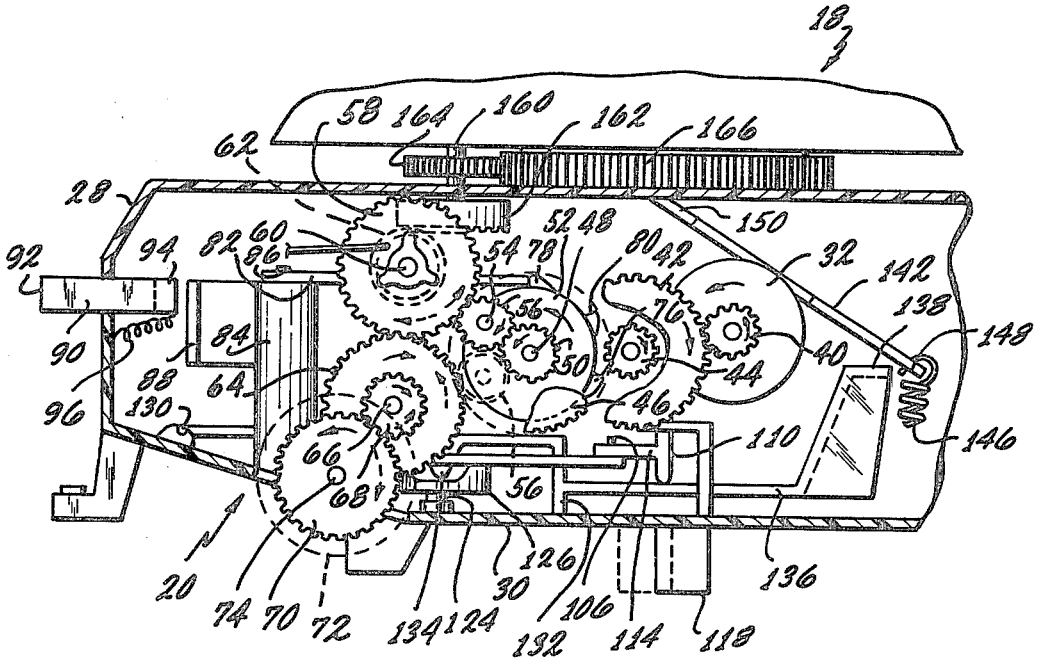
FIG. 3 is a side elevational view in section of certain of the interior components of the vehicle components shown in FIG. 1.

Spur gears 58 and 64 are spatially placed in relationship to drum 52 such that pinion 56 is capable of meshing with and driving both spur gear 58 and 64. This is best seen in FIG. 3. If drum 52 is fixedly held in the position shown in solid line in FIG. 3 pinion 56 meshes with spur gear 58. If pinion 56 is fixedly held in the position shown in phantom in FIG. 3 pinion 56 meshes with and drives spur gear 64. Motor 42 rotates as shown by the solid arrow. This rotation is transferred via pinion 40, spur gear 42, pinion 44, spur gear 46 and pinion 50 to pinion 56. When pinion 56 is engaged with spur gear 58 spur gear 58 is caused to rotate in the direction shown by the solid line. This in turn causes spur gear 64 to rotate in the direction shown by solid lines and this motion in turn is transferred to pinion 68, spur gear 70 and ultimately to driving wheel 72 turning driving wheel 72 in the direction shown by the solid arrow. If instead of engagement with the spur gear 58, pinion 56 is engaged directly with spur gear 64, spur gear 64 is driven in the direction shown by the broken arrow. This also causes spur gear 58 and large pinion 62 to rotate in the direction shown by the broken arrow, the significance which will be described hereinafter, and additionally causes driving wheel to rotate in the direction shown by the broken arrow. This allows for reversal of the direction of the driving wheel 72 depending upon whether pinion 56 is engaged with either spur gear 58 or spur gear 64 and consequently reversal of the direction of travel of vehicle 18.

The placement of pinion 56 is governed by the rotary displacement of drum 52 about axle 48. Drum 52 has three small lugs or teeth 76, 78 and 80 on its surface. A lug retention member 82 fits against lugs 76,78 and 80 respectively. The lugs 76, 78 and 80 are so placed on the surface of drum 52 that when lug 78 is engaged with lug retention member 82 pinion 56 is engaged with spur gear 58. When lug 80 is engaged with lug retention member 82 pinion 56 is engaged with spur wheel 64. When lug 76 is engaged with lug retention member 82 pinion 56 is not engaged with either of spur gears 58 or 64 and as a consequence the motion of motor is not transferred to driving wheel 72 and the vehicle 18 does not move.

When the vehicle 18 is viewed from the direction shown in FIG. 3, the direction of rotation of motor 32 is counterclockwise. By the gearing heretofore described this results in the direction of drum 52 to also be counterclockwise. Because pinion 56 is mounted on axle 54 a counterclockwise momentum is imparted to drum 52 by rotation of pinion 50. This momentum holds the lugs 76, 78 and 80 against the surface of lug retention member 82 whenever lug retention member 82 is directly in line with any of these lugs.

Lug retention member 82 is fixedly attached to the top of a sleeve 84. Sleeve 84 contains a central hole (not separately numbered) allowing sleeve 84 to be slipped over an upright shaft 86 which in turn is attached to bottom section 30. As such sleeve 84 is free to pivot about upright shaft 86 allowing the lug retention member 82 to swing transversely across the surface of drum 52. A centering member 88 is also attached to sleeve 84. Slidably mounted in bottom section 30 is a slidable locking member 90 having a lobe 92 on one end which projects out of the bottom section 30 and is accessible to the operator of the toy and a pair of tines collectively identified by the numeral 94 which project in the opposite direction toward centering member 88. Locking member 90 is biased away from sleeve 84 by a spring 96. When lobe 92 is depressed the tines 94 of locking member 90 slip over centering member 88 and fixedly hold lug retention member 82 in the path of lug 76 and as a consequence of this the vehicle 18 is not driven in either direction but remains stationary even though motor 32 is running.

Figure 5:
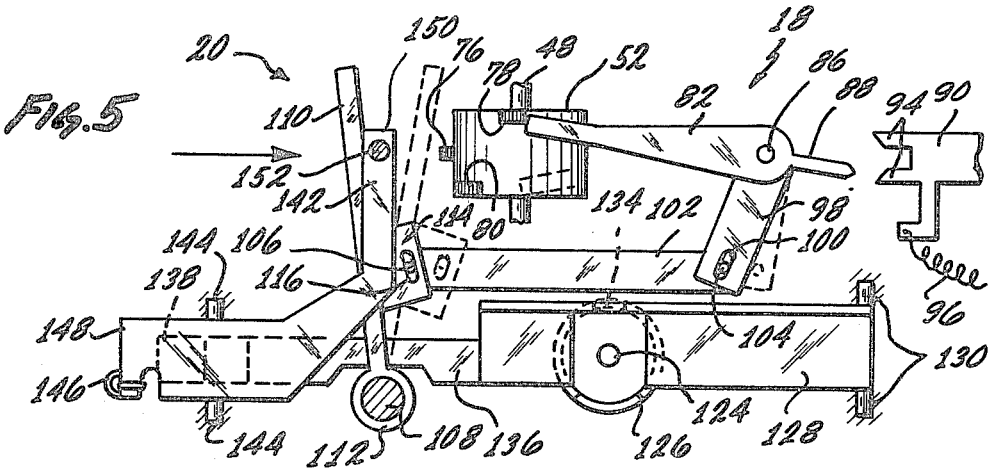
FIG. 5 is a top plan view of certain of the components shown in FIG. 4 and includes in phantom lines an alternate position of the components which are shown in solid lines.
Figure 4:
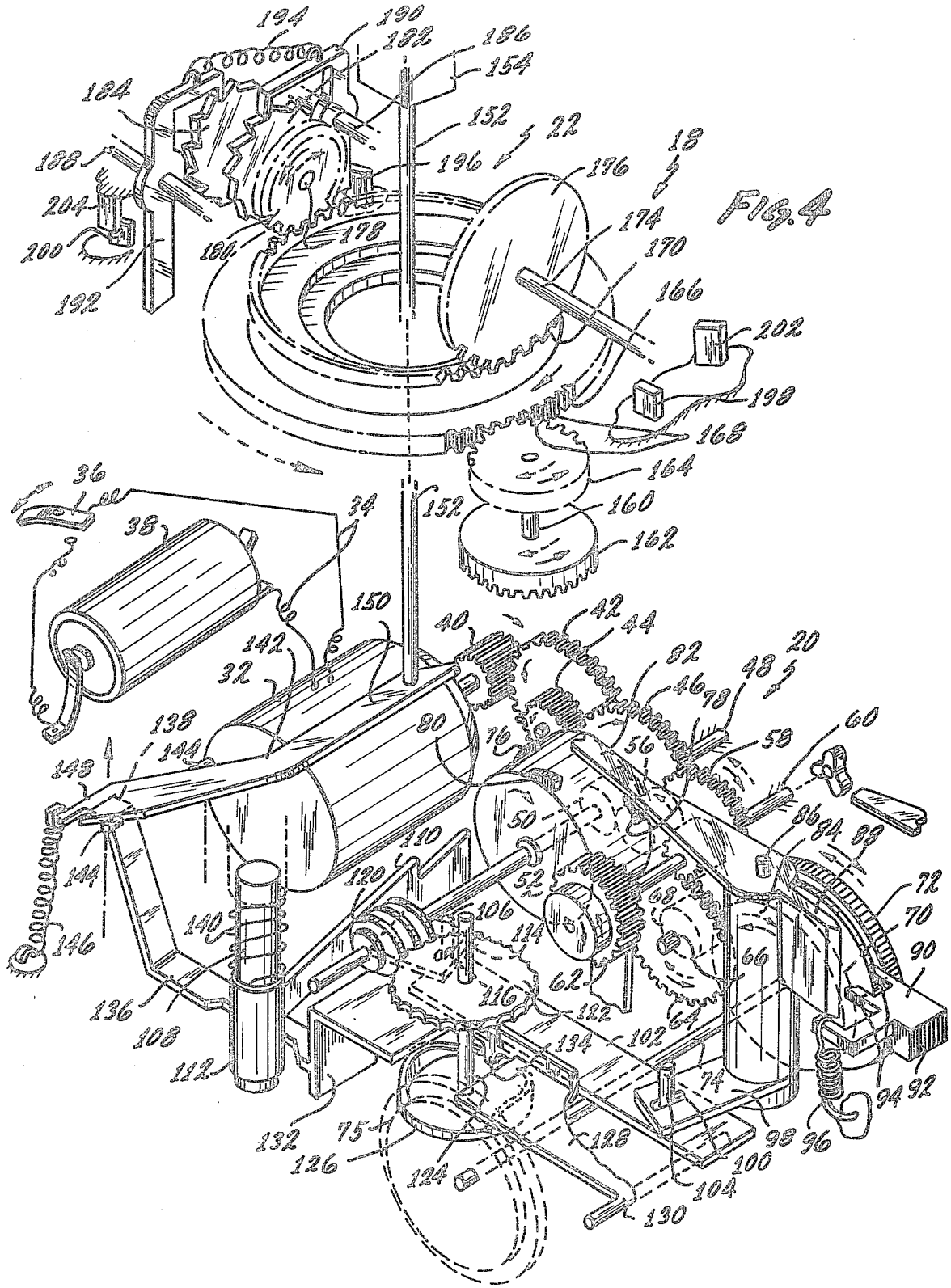
FIG. 4 is an exploded projectional view of the mechanical components inside the vehicle shown in FIG. 1 and further these components are viewed from the opposite side than that shown in FIG. 3.
Figure 6:
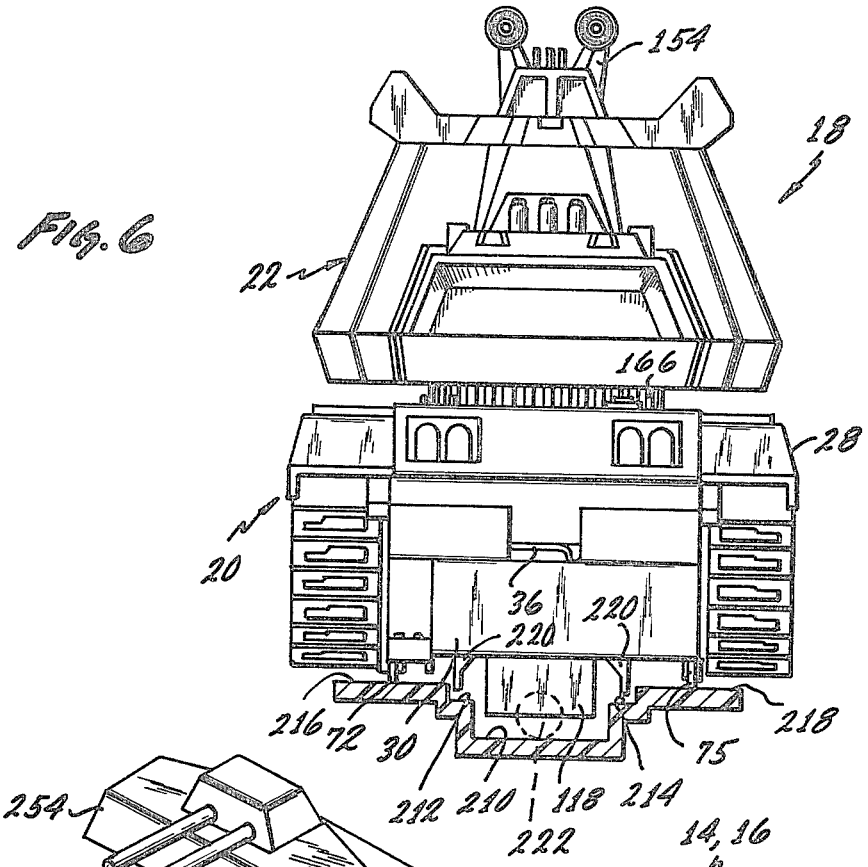
FIG. 6 is an end elevational view of certain of the components taken at the line 6—6 of FIG. 1.

Extending laterally from sleeve 84 near its bottom end is an arm 98. As can be seen in FIGS. 4 and 5, arm 98 projects almost (approximately 70 to 80 degrees) perpendicular to lug retention member 82. Motion of arm 98 about the longitudinal axis of vehicle 18 produces essentially transverse movement of the end of lug retention member 82 across the surface of drum 52 in between the path of lugs 78 and 80 and including an interference position with lug 76. Arm 98 includes an elongated channel 100 nearest the end which is not attached to sleeve 84. A second arm 102 is slidably mounted in a longitudinal position with respect to vehicle 18. Arm 102 has two upstanding pegs 104 and 106 near the end thereof. Peg 104 fits into channel 100 of arm 98.

An upstanding shaft 108 is fixed to bottom section 30 in a position as shown in FIGS. 4 and 5. A transverse member 110 has a bearing section 112 on one end thereof and bearing section 112 fits over shaft 108 allowing transverse member 110 to pivot about shaft 108. Projecting out of the side of transverse member 110 toward arm 102 is a short arm 114. Arm 114 contains a channel 116. Channel 116 fits over upstanding peg 106. A tilt member 118 is integrally formed on the bottom of transverse member 110 and is capable of projecting through a hole (not shown) in the bottom of bottom section 30.

Tilt member 118, as hereinafter described, can be exposed below the bottom surface of bottom section 30. When it is exposed, this allows tilt member 118 to be physically moved by a force on the outside of vehicle 18. Any back and forth movement of tilt member 118 along the longitudinal axis of vehicle 18 is transferred to transverse member 110. Transverse member 110 in turn rotates about shaft 108 causing arm 102 to slide longitudinally back and forth within the interior of bottom section 30. This movement is in turn communicated to arm 98, sleeve 84, and ultimately to lug retention member 82. The position of lug retention member 82 is therefore in a direct response to the longitudinal position of tilt member 118. However, if centering member 88 is fixed by locking member 90 both lug retention member 82 and tilt member 118 are held in a locked position.

On the end of axle 48 distal from pinion 50 is a worm gear 120. A worm wheel 122 is fixedly attached to an upright axle 124 which is free to spin in a bearing surface (not shown) in bottom section 30. Near the lower end of axle 124 is a two-lobed cam wheel 126. Cam wheel 126 is fixedly attached to axle 124 and therefore rotates in respect to rotation of axle 124. As hereinafore described axle 48 turns in respect to motion of motor 32. This rotary motion of axle 48 is transferred to cam wheel 126 by the interaction of worm wheel 122 with worm gear 120 causing cam wheel 126 to rotate.

A lifting member 128 is journaled at one end about two pins collectively identified by the numeral 130 integrally attached to one end of lifting member 128. Pins 130 fit into appropriate bearings in bottom section 30. Lifting member 128 projects from pins 130 across the top surface of cam wheel 126 and then makes a 90° bend and becomes vertical section 132. Vertical section 132 extends down toward the bottom of base section 30. Integrally formed on the undersurface of lifting member 128 is a cam follower 134 which mates with the cam surfaces of cam wheel 126. As cam 126 rotates lifting member 128 is caused to pivot about pins 130. Extending from vertical section 132 of lifting member 128 is lifting extension 136. Lifting extension 136 passes underneath transverse member 110 and then projects upwardly until it culminates at end 138.

An upward and downward motion of lifting member 128 is caused by the interaction of cam follower 134 on the cam surfaces of cam wheel 126 as cam 126 rotates. This upward and downward motion is transmitted to transverse member 110 by lifting extension 136. Transverse member 110 slides up and down about bearing 112 vertically on shaft 108 causing tilt member 118 to alternately project through the bottom of bottom section 30 and then be retracted into the interior of bottom section 30. As this happens arm 114 rides up and down on upstanding peg 106. However, peg 106 is of sufficient length that arm 114 never is completely free of peg 106. A spring 140 fits on shaft 108 and when top section 28 is fitted to bottom section 30 spring 140 abuts against top section 28 and biases transverse member 110 toward the bottom of bottom section 30. This in turn, because transverse member 110 lies across lifting extension 136, holds cam follower 134 against the cam surfaces of cam wheel 126.

A turret lifting member 142 having two pins collectively identified by the numeral 144 is mounted to bottom section 30 about pins 144. A spring 146 biases end 148 of turret lifting member 142 in a downward direction. End 138 of lifting extension 136 fits underneath turret lifting member 142 near end 148. As lifting extension 136 rises and falls with respect to motion of cam wheel 126 this motion is communicated to turret lifting member 142. As end 138 of lifting extension 136 is raised it pushes up on end 148 of turret lifting member 142. Turret lifting member 142 spins about pins 144 and the opposite end 150 of turret lifting member 142 drops. As lifting extension 136 descends in response to the position of cam follower 134 on cam wheel 126 spring 146 biases end 150 of turret lifting member 142 in an upward direction. The upward and downward motion of end 150 of turret lifting member 142 is transferred to a shaft 152 extending from the bottom of a turret signalling device 154. Under the influence of gravity, shaft 152 rests against turret lifting member 142.

Extending down through the center of turret 22 is a large drilling 156. In the center of drilling 156 is a second drilling 158. Turret signalling device 154 is of a smaller dimension than drilling 156 allowing turret signalling device 154 to fit within the interior of drilling 156. Shaft 152 extends from the bottom of turret signalling device 154 through drilling 158 and abuts against turret lifting member 152.

Both the turret signalling device 154 and its attached shaft 152 are free to move within their respective drillings 156 and 158. Since shaft 152 rests on turret lifting member 142 movement of turret lifting member 142 is transferred to turret signalling device 154. Because of the attachment of lifting member 128 about pins 130 and turret lifting member 142 about pins 144, as tilt member 118 is lifted up into the body of bottom section 30 turret signalling device 154 is allowed to descend under the influence of gravity into drilling 156 and as tilt member 118 descends downwards out of the body of bottom section 30 turret signalling device 154 is raised out of the drilling 156. Thus by visually perceiving the position of turret signalling device 154 one knows the position of tilt member 118, i.e. the turret signalling device 154 is up when the tilt member 118 is down and vice versa.

A shaft 160 extends through a hole (not shown) in top section 28. Mounted on the bottom of shaft 160 is a crown wheel 162 and mounted on the top of shaft 160 is a spur wheel 164. As such crown wheel 162 is located within the body of base 20 and spur wheel 164 is held slightly above the top surface of top section 28. Crown wheel 162 mates with large pinion 62 and thus the rotation of large pinion 62 is transferred to spur wheel 164. As hereinbefore described spur gear 58 is capable of being rotated in both a clockwise and a counterclockwise direction. This movement of spur gear 58 is transferred by axle 60 to large pinion 62 which in turn transfers this motion to spur wheel 164 causing spur wheel to move both clockwise and counterclockwise. A large gear 166 rests on the top surface of top section 28 about an upstanding boss (not shown) which extends upward from top section 28. The boss fits into the centralized hole in the center of large gear 166 maintaining large gear 166 centered on base 20. Extending around the perimeter of large gear 166 are spur teeth 168. Extending around the top surface of large gear 166 are crown teeth 170. Spur teeth 168 mesh with crown wheel 162 and as such the rotation of pinion 62 is transferred to large gear 166. A skirt 172 extends down from the bottom of turret 22 and fits inside of crown teeth 170 of large gear 166. This centers turret 22 on large gear 166 and base 20 and allows turret 22 to pivot about large gear 166 and base 20.

A shaft 174 extends horizontally through turret 22 into conical member 24. Conical member 24 is fixedly attached to shaft 174 on one end thereof and a spur gear 176 is fixedly attached to the other end of shaft 174. Spur gear 176 mates with crown teeth 170 and transmits motion of large gear 166 to conical member 24. Since large gear 166 spins in either direction depending upon the direction of pinion 62, conical member 24 also is capable of spinning in both directions.

Within the interior of turret 22 on the side opposite conical member 24 is a shaft 178. Fixedly attached to shaft 178 is spur gear 180 which mates with crown teeth 170 and rotates shaft 178 in respect to its rotation on large gear 166. Two ratchet wheels 182 and 184 are also attached to shaft 178. Ratchet wheel 172 is oriented on shaft 178 so that its teeth project opposite to the direction of the teeth on ratchet wheel 184. Two shafts 186 and 188 extend parallel within turret member 22 to shaft 178. Two escape mechanisms 190 and 192 are mounted about shafts 186 and 188 respectively. Escape mechanism 190 interacts with ratchet wheel 182 and escape mechanism 192 interacts with ratchet wheel 184. A spring 194 connects to both of the tops of escape mechanism 190 and 192 as shown in FIG. 4 and biases the escape mechanism into holding positions with their respective ratchet wheels.

As previously noted large gear 166 is free to spin about a boss extending from the top of top section 28. Referring now specifically to FIG. 4 if spur gear 162 is rotated in the direction shown in solid lines this rotation is transferred to large gear 166 and causes large gear 166 to rotate on the top surface of top section 28 in the direction shown in solid lines. If the escape mechanism 190 was not interacting with ratchet wheel 182 spur gear 180 also would be free to rotate in the direction shown in the solid line. However, as shown in FIG. 4 spur gear 180 cannot turn in the direction shown in the solid line because escape mechanism 190 is locked against ratchet wheel 182. As a consequence of this the turret 22 and the components attached to it, i.e. escape mechanisms 190 and 192, the ratchet wheels 182 and 184 and spur gear 180, are fixedly held in respect to large gear 166. Thus, the turret 22 is locked to large gear 166 and is forced to move in the same direction as large gear 166.

Fixedly attached on the top surface of top section 28 are two ratchet trip pegs 196 and 198 and two stop pegs 200 and 202. As the turret 22 turns in the direction shown in the solid arrow escape mechanism 190 abuts against ratchet trip peg 196 causing the escape mechanism 190 to pivot about axle 186 and free ratchet wheel 182. This allows spur gear 180 to rotate in the direction shown by solid arrow. Just after escape mechanism 190 contacts ratchet trip peg 196 a turret stop peg 204 which extends from the turret toward the top section 28, contacts stop peg 200. This prevents the turret 22 from any further movement in the direction shown by the solid arrow.

When spur wheel 162 is caused to rotate in the direction shown by the broken arrow large gear 166 reverses direction and also turns in the direction shown in the broken arrow. Since spur gear 180 is prevented from traveling in the direction shown in the broken arrow because of interaction of escape mechanism 192 with ratchet wheel 184, turret 22 is caused to spin in the direction shown by the broken arrow. As a consequence of the turret 22 turning in this direction turret stop peg 204 starts to rotate away from stop peg 200 and escape mechanism 190 starts to rotate away from ratchet trip peg 196. The turret 22 then turns 180 degrees with respect to the base 20 until escape mechanism 192 abuts against ratchet trip peg 198. This lifts escape mechanism 192 from the surface of ratchet wheel 184 and allows spur gear 180 to turn in the direction shown by the broken arrow. Shortly thereafter turret stop peg 204 abuts against stop peg 202 holding turret 22 in its new position. The turret 22 will remain in this position until the direction of rotation of spur gear 58 once again is reversed. At this time large gear 166 and turret 22 will again turn in the direction shown by the solid arrow as previously described. Ratchet trip pegs 196 and 198 are so placed in respect to one another on the surface of body 20 that they do not interfer with the interaction of each with its respective escape mechanism.

As a consequence of the reversal of direction of large gear 166 spur gear 176 also turns in both directions. The stop pegs 200 and 202 and the turret stop peg 204 are positioned such that the limits of travel of the turret 22 about large gear 166 result in conical member 24 being pointed either toward one end or the other of the vehicle 18. Further, the stop pegs 200 and 202 are so positioned that conical member 24 points in the direction of travel of the vehicle 18. Because spur gear 176 reverses direction, consequently the conical member 24 will spin one way when pointed toward one end of the vehicle 18 and spin the opposite way when pointed toward the other end. As the result of this opposite spin of conical member 24 the helical screw 26 on the conical member 24 will first turn in toward the body of the vehicle 18 when the vehicle 18 is going in one direction and will turn out away from the body of the vehicle 18 when the vehicle 18 is going in the opposite direction. Along with the reversal of direction of the vehicle 18 this spin of the helical screw 26 makes for an interesting visual effect.

At the opposite end of the vehicle 18 is a second axle 206 having two wheels collectively identified by the numerals 208 on the ends thereof. The wheels 208 are free to spin about axle 206 allowing the vehicle 18 to ride over a surface in response to propulsion by driving wheels 72 and 75.

The track 12 is generally arcuate in shape and extends between the two projectile launchers 14 and 16. The track 12 includes a channel 210 extending down the center of the track. On each side of the channel 210 are shoulders 212 and 214 respectively, and on each side of the shoulders are flat surfaces 216 and 218. Extending from the bottom of the vehicle 18 are two guide members collectively identified by the numeral 220. The guide members 220 fit into the shoulders 212 and 214 and maintain the vehicle 18 on the track 12. The tilt member 118 extends from the bottom of the vehicle 18 partly into the channel 210. When the tilt member 118 is fully extended it is positioned within the channel 210 such that a projectile 222 traversing across channel 210 will strike the tilt member 118.

Depending upon the direction of travel of vehicle 18 on the track 12, if one of a plurality of projectile 222 strike tilt member 118 this may or may not longitudinally displace tilt member 118 with respect to the bottom of vehicle 18. If the vehicle 18 is traveling in the direction toward where the projectile 222 is coming from, the tilt member 118 is capable of being displaced away from the direction of travel of the vehicle 18. In this instance projectile 222 upon striking tilt member 118 will move the tilt member in the direction opposite to the direction of travel of vehicle 18. This will cause the vehicle 18 to reverse its direction and for turret 22 to turn 180°. If, however, the vehicle 18 is traveling away from the direction wherein the projectile 222 is coming from the tilt member 118 will be longitudinally displaced with respect to the vehicle 18 toward the direction of travel of the vehicle 18. If a projectile 222 strikes the tilt member 118 from the back the tilt member 118 is already displaced toward the direction of travel and thus will not be moved by the projectile 222 and neither the direction of travel of the vehicle nor the direction of displacement of the turret will change.

The two projectile launchers 14 and 16 are identical and as such the operation of only one of them, projectile launcher 14, will be described. Projectile launcher 14 has a base 224 and a front surface 226. The front surface 226 contains a broad pin 228 which fits into a respective channel (not shown) at the end of track 12. This locks the track 12 to the projectile launcher 14. Slidably mounted in the base 224 and projecting out of an opening 230 in front surface 226 is a signaling member 232. Signaling member 232 extends out from the front surface 226 over the surface of track 12. If the vehicle 18 approaches too close to the projectile launcher 14, vehicle member 18 abuts against signaling member 232 and depresses signaling member 232 through opening 230 toward the back end 234 of projectile launcher 14. A detent dog 236 projects in an upward direction from end 238 of signaling member 232.

Figure 7:
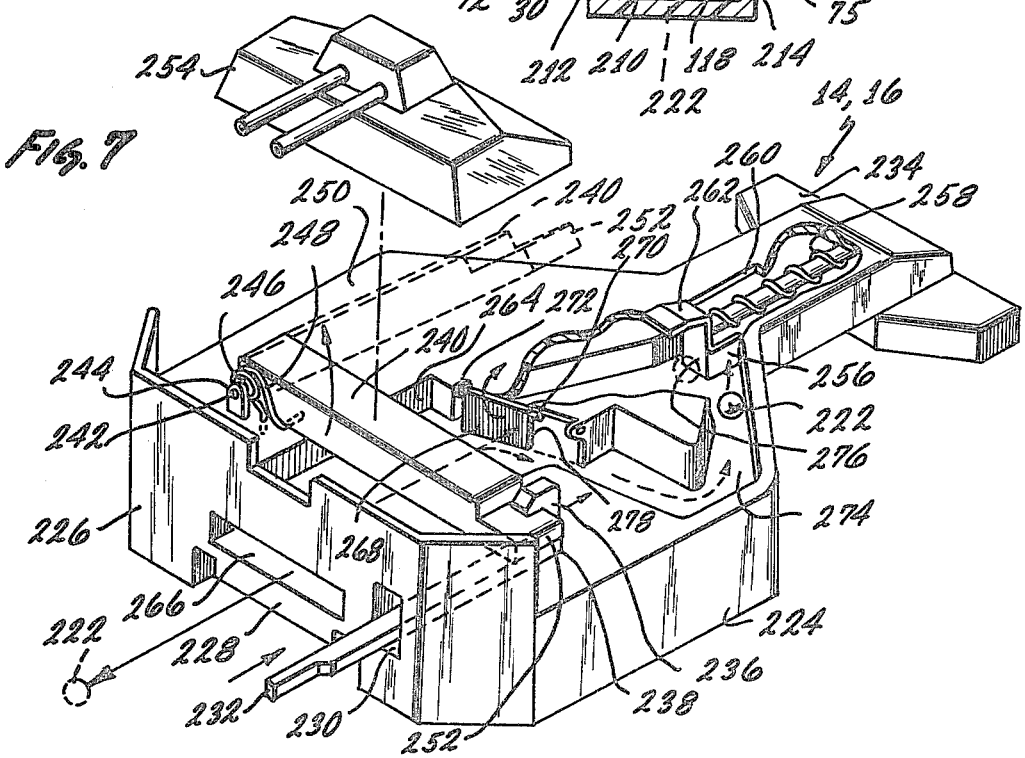
FIG. 7 is a projectional view in partial section of either of the projectile launchers shown at the extreme right and left side of FIG. 1.
Figure 8:
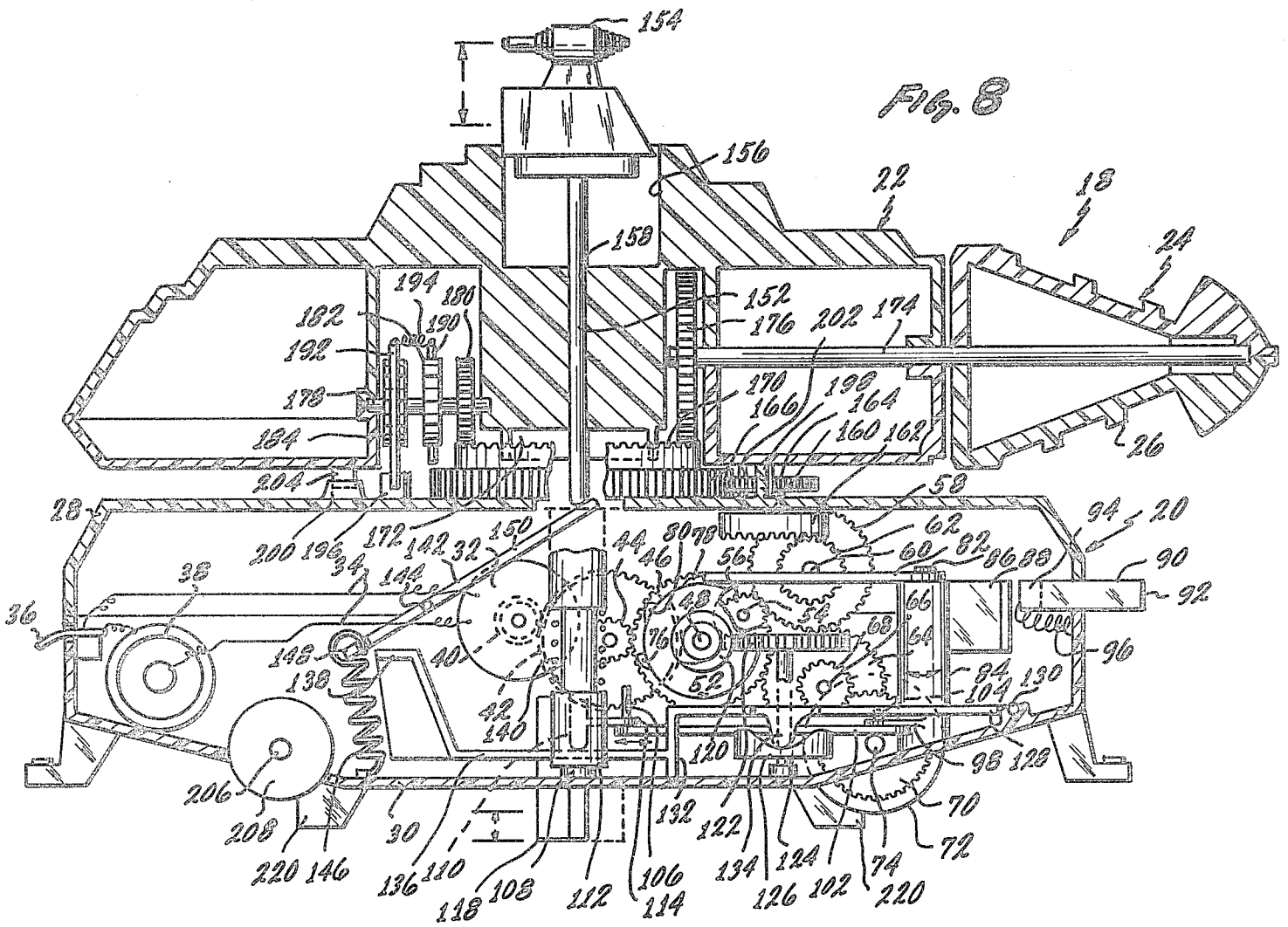
FIG. 8 is a side elevational view in section of the vehicle components of the invention.

A catapult member 240 has a pair of hinge pins collectively identified by the numeral 242 on one end thereof. The hinge pins 242 fit into two ears collectively identified by the numeral 244 having appropriate bearing surfaces 246 therein. A spring 248 fits around one of the hinge pins 242 and underneath catapult member 240. The spring 248 is capable of being compressed between catapult member 240 and the upper surface 250 of projectile launcher 14. When catapult member 240 is swiveled about hinge pins 242 spring 248 is compressed. Continued swiveling of catapult member 240 brings end 252 of catapult member 240 in the proximity of the detent dog 236 on the end of the signaling member 232. The end 252 of catapult member 240 locks underneath detent dog 236 retaining catapult member 240 in the position shown in solid lines in FIG. 7. When vehicle 18 strikes sliding member 232 and slides it toward end 234 of projectile launcher 14, detent dog 236 releases from end 252 and allows catapult member 240 to swivel about hinge pins 242 under the influence of compressed spring 248.

A catapult object 254 in the shape of a gun turret sits on the top of catapult member 240. When catapult member 240 is "tripped" by vehicle 18 striking signaling member 232, catapult member 240 flips or catapults catapult object 254 into the air. This signals that the player who was using projectile launcher 14 has been defeated in the game.

Near the end 234 of projectile launcher 14 is a slidable member 256. A compression spring 258 fits between slidable member 256 and end 234 of projectile launcher 14. A channel 260 extends longitudinally in the upper surface 250 of projectile launcher 14. Attached to slidable member 256 is trigger member 262. Trigger member 262 projects out of channel 260 and allows the operator of the projectile launcher 14 to slide slidable member 256 against the bias of spring 258. When the trigger member 262 is released slidable member 256 is propelled away from end 234 toward track 12. A projectile launching channel 264 extends from slidable member 256 towards the front surface 226 of projectile launcher 14. A second opening 266 in front surface 226 extends from channel 264 through front surface 226 into channel 210 of track 12. Interspaced in channel 264 is a flapper gate 268. Flapper gate 268 is hinged about pins collectively identified by the numeral 270 onto two ears 272 projecting in the upper surface 250 of projectile launcher 14. Flapper gate 268 is movable in a direction toward opening 266 but is fixedly held against the bottom of channel 264 in the opposite direction.

A second channel 274 extends from one side of channel 264 and then bends back toward the back end 234 of the projectile launcher 14. This channel 274 again meets with channel 264 near the front surface 276 of slidable member 256. Flapper gate 268 when in a downward position forms a portion of channel 274. A projectile 222 descending down channel 210 in track 12 rolls through opening 266 and down channel 264. When it strikes flapper gate 268 it is diverted into channel 274 until it again can enter channel 264 next to front surface 276 of slidable member 256. When slidable member 256 is pulled toward end 234 and released, the slidable member 256 propels the projectile 222 through channel 264 and against the inside 278 of flapper gate 268. The projectile 222 flips the flapper gate 268 open and continues in channel 264 through opening 266 and into channel 210 in track 12. By this mechanism projectiles 222 are fired toward vehicle 18 from the two projectile launchers 14 and 16.

When a projectile 222 strikes the tilt member 118 it bounces back and rolls down the channel 210 back to the projectile launcher either 14 or 16 from which it was projected. If, however, the tilt member 118 is retracted into the body of the vehicle 18, then the projectile 222 passes underneath the vehicle 18 and continues on through the channel 210 and ultimately comes to rest in the opposite projectile launcher.

Normally the game is played with a series of projectiles 222, e.g. ten projectiles. At the start of the game the number of projectiles 222 are evenly divided among the two players and the vehicle 18 is placed in the center of the track as depicted in FIG. 1. Lobe 92 of centering member 88 is depressed causing the vehicle to remain stationary. The switch 36 is turned on starting motor 32 which causes tilt member 118 and turret signaling device 154 to begin their respective up and down motions. The first player to hit tilt member 118 when it is the downward position activates the vehicle 18 to move toward the opposite player and causes the turret to point in that direction. The vehicle 18 will continue moving toward the opposite player unless the opposite player strikes the tilt member 118 with one of his projectiles 222. If the projectile 222 goes underneath the vehicle 18 when the tilt member 118 is retracted the projectile 222 goes toward the opposite projectile launcher giving the other player an additional projectile 222 and thus an advantage. The game is played until one of the players is unable to keep the vehicle 18 from striking the signaling member 232 on his respective projectile launcher.

The missile launchers 14 and 16 only propel the projectile 222 at a sufficient velocity to travel through the channel 210 and not to escape from the channel 210. The trip member 118 does not require a very hard force in order to move it from one position to another. Because of this a small child would not be able to use the projectile launchers 14 and 16 in a manner which would endanger another individual.

For a more realistic effect during the operation of the vehicle 18 shaft 60 contains a three lobed cam 278 on the end opposite of spur gear 62. A flexible member 280 integrally formed with top body section 28 extends toward and slightly touches cam 278. Rotation of axle 60 causes cam 278 to flip against flexible member 280 emitting a sound imitating a motor-like noise.

I claim:

1. A toy which comprises:

a track, said track having a first end and a second end;

two projectile launchers, one projectile launcher integrally mating with said first end of said track, the second projectile launcher integrally mating with said second end of said track;

at least one projectile, each of said first or said second projectile launchers being capable of ejecting said projectile across said track;

an object member, said object member including self-propelled motor means for independently moving said object member across the surface of said track reversibly between said first projectile launcher and said second projectile launcher;

said object member including reversing means for reversing the direction of said movement of said object member across the surface of said track;

said reversing means including a control means for controlling the direction of said object member;

said reversing means reversing said direction of said object member across the surface of said track in response to impingement of said projectile upon said control means.

2. The toy of claim 1 including:

a plurality of said projectiles.

3. The toy of claim 1 wherein:

said object member includes exposure means for exposing said control means alternately between an exposed position wherein said projectile can strike said object member and a protected position wherein said projectile cannot strike said object member.

4. The toy of claim 3 wherein:

said object member includes a bottom surface;

a rolling means for movably supporting said object member over said track, said rolling means mounted on said bottom surface of said object member;

said self-propelled motor means operatively connected to said rolling means such that said object member moves backward and forward across said track between said first and said second projectile launchers in response to said self-propelled motor means.

5. The toy of claim 4 wherein:

said control means comprises a trip member extending from said bottom surface of said object member, said trip member having a first position wherein said object member moves in a first direction toward one of said projectile launchers, said trip member having a second position wherein said object member moves in the opposite direction toward the other of said projectile launchers, said trip member exposed to the pathway of said projectile such that when said projectile is ejected from said first projectile launcher and said trip member is in said first position and said projectile strikes said trip member, said projectile trips said trip member to said second position and said object member moves in said opposite direction and when said object member is moving in said opposite direction and said trip member is in said second position and a projectile is ejected from said other projectile launcher and said projectile strikes said trip member tripping said trip member to said first position, said object member changes direction to said first direction.

6. The toy of claim 5 wherein:

each of said projectile launchers includes a base; and each of said projectile launchers includes an ejecting means for ejecting said projectile, said ejecting means mounted on said base.

7. The toy of claim 6 wherein:

said track includes two continuous surfaces extending from said first end of said track to said second end of said track, the first of said surfaces depressed below the plane of the second of said surfaces, said first surface defining a projectile pathway between said first end and said second end of said track and extending from one of said projectile launchers to the other of said projectile launchers;

the second of said surfaces extending from said first end of said track to said second end of said track and defining a supporting surface for said object member;

said control means extending from said object member toward said first surface.

8. The toy of claim 7 wherein:

said track comprises an arcuated track extending from said first projectile launcher to said second projectile launcher;

said first of said surfaces comprises a bottom surface of a depressed channel extending along the longitudinal axis of said track between said first projectile launcher and said second projectile launcher;

said first and said second projectile launchers ejecting said projectile into said depressed channel.

9. The toy of claim 6 wherein:

each of said ejecting means includes a slidable member slidably mounted on said base;

each of said bases includes a front surface, one end of said track attaching to one of said front surfaces on one of said bases, the other end of said track attaching to the other of said front surfaces on the other of said bases;

biasing means for forcibly biasing said slidable members toward said front surfaces, trigger means for sliding said slidable member, said trigger means attaching to said slidable member such that when said trigger means is moved away from said front surface said slidable member slides away from said front surface and when said trigger means is released said biasing means biases said slidable member toward said front surface.

10. The toy of claim 9 wherein:

each of said bases includes a projectile return channel, said projectile return channel directing said projectile away from said ejecting means when said projectile moves in a direction from said track toward said projectile launcher.

11. The toy of claim 9 wherein:

each of said projectile launchers includes a signaling means for signaling when said object member approaches said projectile launcher.

12. The toy of claim 11 wherein:

said signaling means includes each of said bases having a signaling member extending from the front surface of said base such that when said object member approaches said projectile launcher said object member engages said signaling member;

each of said bases includes a catapult member having a first end and a second end, said first end of said catapult member pivotally attaching to said base such that said second end of said catapult member moves in an arc about said first end;

a catapult biasing means biasing said second end of said catapult member in said arc;

each of said bases includes a catch means for engaging with said second end of said catapult member, said catch means operatively attached to said signaling member, said catch means engaging with said second end of said catapult member and reversably holding said second end of said catapult member from being moved in said arc by said biasing means.

13. The toy of claim 12 including:

a catapult object, said catapult object fitting on said catapult member when said catch means is engaged with said second end and said catapult member catapulting said catapult object when said catch means is disengaged from said second end.

* * * * *